US005478792A

United States Patent [19]

Seno et al.

[11] Patent Number: 5,478,792

[45] Date of Patent: Dec. 26, 1995

[54] HEAT-SENSITIVE RECORDING MATERIAL

[75] Inventors: Eriko Seno, Kurashiki; Tetsuya Katayama, Osaka; Hirotoshi Miyazaki, Kurashiki, all of Japan

[73] Assignee: Kuraray Co., Ltd., Kurashiki, Japan

[21] Appl. No.: 305,448

[22] Filed: Sep. 13, 1994

[51] Int. Cl.[6] ..... B41M 5/30

[52] U.S. Cl. ..... 503/209; 503/214

[58] Field of Search ..... 427/150, 151; 503/214, 225, 209

[56] References Cited

FOREIGN PATENT DOCUMENTS

| | | | |
|---|---|---|---|
| 62-105687 | 5/1987 | Japan . | |
| 63-176174 | 7/1988 | Japan . | |
| 1-111439 | 4/1989 | Japan . | |
| 3-234754 | 10/1991 | Japan | 503/214 |

OTHER PUBLICATIONS

Database WPI, Derwent Publications, AN–84–272013, JP–59–159394, Sep. 8, 1984.

Database WPI, Derwent Publications, AN–94–363286, JP–6–286315, Oct. 11, 1994.

*Primary Examiner*—B. Hamilton Hess

*Attorney, Agent, or Firm*—Oblon, Spivak, McClelland, Maier, & Neustadt

[57] ABSTRACT

A heat-sensitive recording material with a heat-sensitive recording layer comprising a modified polyvinyl alcohol containing 2.5 to 8 mole % of a carboxyl group-containing monomer units and having a degree of saponification of 40 to 65 mole % and a viscosity average degree of polymerization. of 50 to 500; a dispersing agent comprising the above modified polyvinyl alcohol for heat-sensitive dyes or color developing agents that can make the heat-sensitive dyes form color upon heating; and a process for producing aqueous dispersions which comprises dispersing a heat-sensitive dye or a color developing agent that can make the heat-sensitive dye form color upon heating, in an aqueous medium with a dispersing agent of the above modified polyvinyl alcohol. The aqueous dispersion obtained, having excellent applicability to the surface of the base paper upon preparation of heat-sensitive recording papers and containing dispersoids of a heat-sensitive dye and a color developing agent dispersed in fine particles, can produce heat-sensitive recording materials having markedly high resolution.

9 Claims, No Drawings

HEAT-SENSITIVE RECORDING MATERIAL

BACKGROUND OF THE INVENTION

1. Field of the Invention

The present invention relates to a heat-sensitive recording material.

The present invention further relates to a dispersing agent having excellent dispersing capability for heat-sensitive dyes and color developing agents and suited for producing heat-sensitive recording materials.

The present invention still further relates to a process for producing aqueous dispersions having a dispersoid of a particulate heat-sensitive dye or color developing agent.

2. Description of the Prior Art

Heat-sensitive recording materials comprise a paper, plastic film or metal-deposited paper and, provided thereon, a heat-sensitive recording layer that will undergo, by heat energy, chemical or physical change to form color and give recorded images. The heat-sensitive recording materials have advantages of giving recorded images by simple heating, requiring no complex treatments such as developing and fixing, causing no noise upon recording and providing relatively inexpensive recording system. The materials therefore have been widely used as recording materials for electronic calculators, word processors, telex machines, facsimiles and various calculators.

These heat-sensitive recording materials generally have a heat-sensitive recording layer comprising a colorless or light-color leuco dye and an acid such as an organic acid or a phenol, that reacts upon heating with the leuco dye, thereby causing it to form color.

In recent years, in particular in the field of facsimiles and the like, where the printing speed has been increasing year by year, there has been desired a heat-sensitive recording material capable of giving more clear images and conforming to high-speed printing. With respect to recorded images, there is required a heat-sensitive recording material capable of giving precise and dirt-free images not only for characters but also for drawings and photographs.

As a result, strongly desired is a heat-sensitive recording material having heat-sensitive recording layer in which a heat-sensitive dye and a color developing agent (developer) having a particle diameter of not more than 1 micron are dispersed uniformly and present in high density and in a thin layer, so that the color of the texture of the substrate used is not observable.

Known dispersing agents for heat-sensitive dyes and color developing agents include a partially saponified polyvinyl alcohol having a low molecular weight, a sulfonic acid group-modified polyvinyl alcohol having a low molecular weight, and alkali metal salts or ester of an α-olefinmaleic anhydride copolymer. However, these agents have been incapable of exhibiting sufficient performance.

The partially saponified polyvinyl alcohol having a low molecular weight has insufficient dispersing capability for heat-sensitive dyes and color developing agents and cannot stably disperse them in a particle size of not more than micron.

The sulfonic acid-modified polyvinyl alcohol having a low molecular weight has a dispersing capability of some level but make considerably visible the texture color of the substrate.

The maleic anhydride-based copolymer is, when used in a coating liquid, only insufficiently compatible with the binder contained in the liquid, thereby often causing agglomeration of dispersed particles or viscosity increase of the liquid and, further, has the problem of making considerably visible the texture color of the substrate.

SUMMARY OF THE INVENTION

Accordingly, an object of the present invention is to provide a heat-sensitive recording material capable making invisible the texture color of the substrate and giving clear images even upon high-speed printing.

Another object of the present invention is to provide a dispersing agent having excellent dispersing capability for particulate heat-sensitive dyes and color developing agents and suited for producing heat-sensitive recording materials.

Still another object of the present invention is to provide a process for producing aqueous dispersions having a dispersoid of a particulate heat-sensitive dye or color developing agent.

As a result of an intensive study to solve the above problems, the present inventors have found:

- a heat-sensitive recording material having a heat-sensitive recording layer comprising a modified polyvinyl alcohol containing 2.5 to 8 mole % of a carboxyl group-containing monomer units and having a degree of saponification of 40 to 65 mole % and a viscosity average degree of polymerization of 50 to 500;
- a dispersing agent comprising the above modified polyvinyl alcohol for heat-sensitive dyes or color developing agents that can make the heat-sensitive dyes form color upon heating; and
- a process for producing aqueous dispersions which comprises dispersing a heat-sensitive dye or a color developing agent that can make the heat-sensitive dye form color upon heating, in an aqueous medium with a dispersing agent of the above modified polyvinyl alcohol; to complete the invention.

DETAILED DESCRIPTION OF THE PREFERRED EMBODIMENTS

The modified polyvinyl alcohol (hereinafter the term "polyvinyl alcohol" is sometimes referred to as "PVA") used in the present invention should contain 2.5 to 8 mole % of units from a carboxyl group-containing monomer and have a degree of saponification of 40 to 65 mole % and a viscosity average degree of polyvinyl alcohol of 50 to 500.

It is necessary that the content of the carboxyl group-containing monomer units be 2.5 to 8 mole %, preferably 3 to 6 mole %. With the degree of modification by carboxyl group being less than 2.5 mole %, the printed parts on the heat-sensitive recording material have a low color density and the PVA has low dispersing capability for heat-sensitive dyes and color developing agents so that the dispersoid agglomerates after an aqueous dispersion has been prepared. With the degree of modification exceeding 8 mole %, the non-printed part on the heat-sensitive recording material has a low whiteness and aqueous dispersions prepared with the PVA also have a very low whiteness.

There is no specific limitation to the type of the carboxyl group-containing monomer unit and its examples include units from fumaric acid, maleic acid, iraconic acid, maleic anhydride, phthalic anhydride, trimellitic anhydride and iraconic anhydride. Among these monomer units, dibasic acids are preferred and itaconic acid is particularly preferred.

It is necessary that the modified PVA have a degree of saponification of 40 to 65 mole %., preferably 45 to 60 mole and more preferably 50 to 60 mole %. If the degree of saponification is less than 40 mole %, the dispersing capability for heat-sensitive dyes and color developing agents will decrease and aqueous dispersions prepared with the PVA will, after preparation thereof, cause the dispersoid to agglomerate, so that a usable heat-sensitive recording material cannot be obtained. If the degree of saponification exceeds 65 mole %, the resulting heat-sensitive recording material will give printed parts having a low color density and, besides, aqueous dispersions prepared with the PVA will have too high a viscosity to handle with ease so that the concentration of the dispersions cannot be elevated.

The viscosity average degree of polymerization (hereinafter simply referred to as "degree of polymerization") of the modified PVA should be in a range of 50 to 500 and is preferably in a range of 100 to 300. If the degree of polymerization is less than 50, the PVA will become incapable of dispersing fine particles and, after preparation of an aqueous dispersion, the dispersoid will agglomerate, whereby a usable heat-sensitive recording material cannot be obtained. If the degree of polymerization exceeds 500, the resulting heat-sensitive recording material will give printed parts having a low color density and, besides, aqueous dispersions prepared with the PVA will have too high a viscosity to handle with ease so that the concentration of the dispersions cannot be elevated.

The carboxyl group-modified PVA can be prepared by any process with no specific restrictions. For example, one of the above mentioned carboxylic acids is reacted with polyvinyl alcohol by post-reaction, or a copolymer of vinyl acetate and an ethylenically unsaturated carboxylic acid is saponified. Concrete examples of such processes are disclosed in Japanese Patent Publication No. 21312/1970 and Japanese Patent Application Laid-open Nos. 91995/1978, 28389/1979 and 28390/1979.

The carboxyl groups in the PVA of the invention may either be present in the form of an alkali metal salt such as COONa or in the form of COOH. Where the carboxyl group-containing monomer is a dibasic acid, one of the two carboxylic acids present in the monomer may form a lactone ring.

The carboxyl group-modified polyvinyl alcohol used in the present invention may be copolymerized with other monomers or its ends may be modified by using a chain transfer agent. Any ethylenically unsaturated monomer may be copolymerized with a vinyl ester as long as it is copolymerizable therewith. Examples of such monomers are α-olefins, e.g. ethylene, propylene, n-butene, isobutene and 1-hexadecene; carboxylic acid-containing monomers, e.g. (meth)acrylic acid, fumaric acid, crotonic acid, maleic acid and maleic anhydride, and salts of the foregoing; (meth-)acrylic acid esters, e.g. methyl (meth)acrylate, n-butyl (meth)acrylate, 2-hydroxyethyl (meth)acrylate, 2-ethylhexyl (meth)acrylate and stearyl (meth)acrylate; other esters, e.g. dimethyl fumarate, dimethyl itaconate, dimethyl maleate, monomethyl maleate and methyl crotonate; vinyl ethers, e.g. methyl vinyl ether, butyl vinyl ether, lauryl vinyl ether and stearyl vinyl ether; sulfonic acid group-containing monomers, e.g. vinylsulfonic acid, allylsulfonic acid, methallylsulfonic acid and 2-acrylamide-2-methylpro-panesulfonic acid, and salts of the foregoing; amido group-containing monomers, e.g. (meth) acrylamide, N,N-dimethyl-(meth)acrylamide, N-methylol(meth)acrylamide, N-t-butoxy(meth) acrylamide, N-toctyl(meth) acrylamide and N-vinylpyrrolidone; quaternary ammonium salt-containing monomers, e.g. dimethylaminoethyl(meth)acrylamide; silyl group-containing monomers, e.g. vinylhydroxysilane and 3-trimethoxysilylpropyl (meth)acrylate; and acetyl group-containing monomers, e.g. allyl acetate, dimethylallyl acetate and isopropenyl acetate.

The modified PVA can be contained in a heat-sensitive recording layer of the heat-sensitive recording material in any amount with no particular limitation. However, it is preferred that the modified PVA be contained in an amount of 3 to 30 parts by weight based on 100 parts by weight of the sum of the amounts of a heat-sensitive dye and a color developing agent, more preferably 5 to 20 parts by weight and most preferably 7 to 16 parts by weight on the same basis.

For the preparation of aqueous dispersions of a heat-sensitive dye or a color developing agent according to the present invention, the dye or agent is dispersed by using a dispersing agent of the above modified PVA. The dispersing agent can be used in any amount, but preferably in an amount of 3 to 30 parts by weight based on 100 parts by weight of the heat-sensitive dye or the color developing agent, more preferably 5 to 20 parts by weight and most preferably 7 to 15 parts by weight on the same basis. In general, it is desirable to prepare aqueous dispersions of a heat-sensitive dye and a color developing agent separately and then mix the two dispersions. The finished aqueous dispersion preferably has a dispersoid concentration of 20 to 70% by weight, more preferably 40 to 60% by weight.

Dispersing operation for the heat-sensitive dye or the color developing agent is carried out in a sand mill containing a multiplicity of glass beads having an average particle diameter of 0.2 to 3 mm (preferably 0.3 to 0.8 mm). The dispersing operation is completed in 1 hour to 1 week (preferably 3 hours to 4 days, in particular 1 to 4 days where it is desired to obtain fine dispersoid particles having an average particle diameter of not more than 0.45 μm).

The use of the dispersing agent of the present invention can give aqueous dispersions having a dispersoid of a heat-sensitive dye or a color developing agent having a particle diameter ranging from 0.1 to 1 μm (preferably 0.3 to 0.8 μm, more preferably 0.2 to 0.6 μm and most preferably 0.2 to 0.45 μm).

Any heat-sensitive dye being used for conventional pressure- or heat-sensitive papers can be used in the present invention and its concrete examples include triarylmethane-based compounds, e.g. 3,3 -bis(p-dimethylaminophenyl)-6-dimethylaminophthalide (Crystal Violet Lactone), 3-(p-dimethylaminophenyl)-3-(1,2-dimethylindole-3-yl)phthalide, 3-(p-dimethylaminophenyl)-3-(2-phenylindole-3-yl)phthalide and 3,3-bis-(9-ethylcarbazole-3-yl-5-dimethylaminophthalide; diphenylmethane-based compounds, e.g. 4,4'-bis-dimethylaminobenzhydrine benzyl ether and N-halophenylleucoauramine: xanthene-based compounds, e.g. rhodamine B-anilinolactam, 3-diethylamino-7-benzylamino-fluorane, 3 -diethylamino-7-butylaminofluorane, 3-diethylamino-7-(chloroanilino)fluorane, 3-diethylamino-6-methyl-7-anilinofluorane, 3-piperidino-6-methyl-7-anilinofluorane, 3-ethyl-tolylamino-6-methyl-7-anilinofluorane, 3-cyclohexyl-methylamino-6 -methyl-7-anilinofluorane, 3-diethylamino-6-chloro-7-(β-ethoxyethyl)aminofluorane, 3-diethylamino-6-chloro-7-(γ-chloropropyl)aminofluorane, 3-(N-ethyl-N-isoamyl-6-methyl-7-phenylaminofluorane and 3-dibutylamino-6-methyl-7-anilinofluorane; thiazine-based compounds, e.g. benzoyl leuco methylene blue and p-nitrobenzoyl leuco methylene blue; and spiro compounds, e.g. 3-methyl-spiro-dinaphthopyrane, 3 -ethyl-spiro-dinaphthopyrane, 3-benzyl-spiro-dinaphthopyrane, 3-methyl-naphto-(3-methoxy-benzo)-spiro-pyrane. These compounds may be used singly or in combination of two or more. These heat-sensitive dyes are appropriately selected according to the use of the intended heat-sensitive recording material.

It is desirable that the color developing agent used in the present invention be selected from phenol derivatives and aromatic carboxylic acid derivatives, in particular from bisphenols. Their concrete examples are phenols, e.g. p-octylphenol, p-tert-butylphenol, p-phenylphenol, 1,1-bis(p-hydroxyphenyl)propane, 1,1-bis(p-hydroxyphenyl)pentane, 2,2-bis(p-hydroxyphenyl)propane, 1,1-bis(p-hydroxyphenyl)hexane, 2,2-bis(p-hydroxyphenyl)hexane, 1,1-bis(p-hydroxyphenyl-2 -ethyl-hexane, 2,2-bis(4-hydroxy-3,5-dichlorophenyl)propane and dihydroxydiphenyl ether; and aromatic carboxylic acid derivatives, e.g. p-hydroxybenzoic acid, ethyl p-hydroxybenzoate, butyl p-hydroxybenzoate, 3,5-di-tert-butylsalicylic acid and 3,5-di-α-methylbenzylsalicylic acid and multivalent metal salts of the above carboxylic acids.

It is desirable, in the present invention, to use an aqueous binder in a heat-sensitive recording layer. Examples of binders usable for this purpose are cellulose derivatives, e.g. starch, starch derivatives, hydroxymethylcellulose, hydroxyethylcellulose, carboxymethylcellulose, methylcellulose and ethylcellulose; water-soluble polymers, e.g. polyvinyl alcohol, poly(sodium acrylate), polyvinylpyrrolidone, acrylamide/acrylic acid ester copolymers, acrylamide/acrylic acid ester/methacrylic acid ternary copolymers, alkali metal salts of styrene/maleic anhydride copolymer, alkali metal salts of isobutylene/maleic anhydride copolymer; polyacrylamide, sodium alginate, gelatin and casein; emulsions of polyvinyl acetate, polyurethanes, polyacrylic acid, polyacrylic acid esters, vinyl chloride/vinyl acetate copolymer, polybutyl methacrylate, ethylene/vinyl acetate copolymer and the like; and latices of styrene/butadiene copolymer, styrene/butadiene/acrylic acid ester and the like.

The aqueous binder is added preferably in an amount of 1 to 20 parts by weight based on 100 parts by weight of the sum of the amounts of the dye and the color developing agent.

In the present invention, the heat-sensitive recording layer may incorporate, besides a heat-sensitive dye and a color developing agent, auxiliary additives used for conventional heat-sensitive recording materials, such as a filler, surfactant, heat-fusible substance (or lubricant) and agent for preventing color development under pressure.

In the present invention, the heat-sensitive recording layer can be formed by any of known processes, e.g. air-knife coating, plate coating, embossing, roll coating, spraying, dipping, bar coating and extrusion coating.

In the present invention, any substrate can be used for the heat-sensitive recording material. Appropriate selection is made for example from various papers, synthetic papers and synthetic resin films. It is, however, generally desirable to use a paper.

The heat-sensitive recording materials of the present invention give printed parts having good color development and non-printed part that hardly fogs (coloration of substrate). The heat-sensitive recording materials of the present invention, having excellent high-speed printability and excellent resolution of images, are suitably usable in the field requiring high-speed printing, such as facsimile.

The dispersing agent of the present invention, having excellent dispersing capability for heat-sensitive dyes and color developing agents, can give aqueous dispersion having a dispersoid of a particulate heat-sensitive dye or color developing agent in a high concentration and having a low viscosity. The aqueous dispersion obtained, having excellent applicability to the surface of the base paper upon preparation of heat-sensitive recording papers and containing dispersoids of a heat-sensitive dye and a color developing agent dispersed in fine particles, can produce heat-sensitive recording materials having markedly high resolution.

EXAMPLES

Other features of the invention will become apparent in the course of the following descriptions of exemplary embodiments which are given for illustration of the invention and are not intended to be limiting thereof. In the Examples and Comparative Examples that follow, "parts" and "%" mean "parts by weight" and "% by weight", respectively, unless otherwise indicated. The viscosity values in the following description are those measured with a Brookfield viscometer made by Tokyo Keiki Co., Ltd. at 30° C. and a rotor rotation of 12 rpm.

Example 1

(1) Preparation of coating liquid (dispersion of heat-sensitive dye and color developing agent)

| | |
|---|---|
| A. Preparation of aqueous dispersion of heat-sensitive dye | |
| Leuco dye (S-205, made by Yamada Kagaku K.K.) | 20% |
| Ten % aqueous solution of a carboxyl group-modified PVA (modified by copolymerization of 4 mole % of itaconic acid; degree of polymerization: 500; degree of saponification: 46 mole %) | 20% |
| Water | 59.9% |
| Antifoam (SURFYNOL 440, made by Nisshin Chemical Co., Ltd.) | 0.1% |
| B. Preparation of aqueous dispersion of color developing agent) | |
| Bisphenol A | 20% |
| Ten % aqueous solution of a carboxyl group-modified PVA (same as one used above) | 20% |
| Water | 59.9% |
| Antifoam (SURFYNOL 440, made by Nisshin Chemical Co., Ltd.) | 0.1% |
| C. Aqueous dispersion of pigment (filler) | |
| Stearylamide | 10% |
| Calcium carbonate | 20% |
| Five % aqueous solution of a carboxyl group-modified PVA (same as one used above) | 30% |
| Water | 40% |

The above aqueous mixtures A, B and C were separately prepared and stirred preliminarily for 15 minutes.

The aqueous mixtures A and B were each transferred into a sand mill (batch type, desk-top sand mill made by Kansai Paint Co.), and 300 cc of glass beads (soda quartz glass having a diameter of 0.5 mm) was added. Dispersion was effected at a high rotation (2,170 rpm) for 6 hours.

The aqueous mixture C was dispersed in a homogenizer (10,000 rpm) for 2 minutes.

The aqueous dispersion A of the heat-sensitive dye was evaluated according to the following methods.

Particle diameter of dispersoid

Six hours after starting dispersion, the particle diameter was measured with a laser diffraction particle size analyzer (SALD-1000, made by Shimadzu Corp.).

Viscosity of aqueous dispersion

The aqueous dispersion was allowed to stand for about1 hour after completion of 6-hour dispersion and then tested for viscosity at 30° C.

Whiteness of aqueous dispersion

The aqueous dispersion was allowed to stand for about 1 hour after completion of 6-hour dispersion and then tested for whiteness with a color and color and color difference meter (Z-1001DP, made by Nippon Denshoku Kogyo Co., Ltd.). The whiteness value of "0" means completely white, and the degree of discoloration increases with the absolute value of the negative values.

(2) Preparation of heat-sensitive recording paper

A coating liquid for heat-sensitive recording layer was prepared by mixing with stirring 1 part of the aqueous dispersion A, 4 parts of the aqueous dispersion B, 2 parts of the aqueous dispersion C and 2 parts of a 10% aqueous solution of polyvinyl alcohol (degree of polymerization: 1,750, degree of saponification: 98.5 mole %). The coating liquid was applied with a wire bar coater on a base paper (woodfree paper having a weight of 52 g/m$^2$) in an amount of 6 g/m$^2$ (solid base), dried at 50° C. for 10 minutes and then surface-treated with a super calender (linear pressure: 30 kg/cm; roll diameter: top (metal): 20 cm, bottom (rubber): 30 cm), to obtain a heat-sensitive recording paper.

The heat-sensitive recording paper thus obtained was evaluated in the following manner.

Color density of the printed part on heat-sensitive recording paper

Printing was made on the paper with a printer for heat-sensitive facsimile (RIFAX 300, made by Ricoh Co.) and the color density of the printed parts were measured with a Macbeth color density tester (RD-514, made by Macbeth Co.).

Color density of the non-printed part on heat-sensitive recording paper

The non-printed part was measured for color density with the same Macbeth tester as above.

A Macbeth density of 0 and 1.82 means completely white and completely black, respectively.

The results of evaluations on the above aqueous dispersion A of the heat-sensitive dye and the heat-sensitive recording material are shown in Table 1.

Examples 2 through 11

Example 1 was repeated except that iraconic acid-modified polyvinyl alcohols as shown in Table 1 were used, instead of the itaconic acid-modified polyvinyl alcohol used in Example 1, to prepare coating liquids (dispersions of the heat-sensitive dye and the color developing agent). The obtained coating liquids were then used to prepare heat-sensitive recording materials in the same manner. The results are shown in table 1.

Comparative Examples 1 through 8

Example 1 was repeated except that various polyvinyl alcohols as shown in Table 1 were used, instead of the iraconic acid-modified polyvinyl alcohol used in Example 1, to prepare coating liquids (dispersions of the heat-sensitive dye and the color developing agent). The obtained coating liquids were then used to prepare heat-sensitive recording materials in the same manner. The results are also shown in table 1.

Obviously, numerous modifications and variations of the present invention are possible in light of the above teachings. It is therefore to be understood that within the scope of the appended claims, the invention may be practiced otherwise than as specifically described herein.

TABLE 1

| | Dispersing agent (PVA) | | | | Aqueous dispersion of heat-sensitive dye | | | Properties of heat-sensitive recording paper (color density) | |
|---|---|---|---|---|---|---|---|---|---|
| | Comonomer (*1) | D.M. (mole %) (*2) | D.S. (mole %) (*3) | D.P. (*4) | Dia. (μm) (*5) | Viscosity (cps) | White-ness | Printed part | Non-printed part |
| Ex. 1 | IA | 4.0 | 46 | 500 | 0.44 | 38.0 | −8.0 | 1.34 | 0.08 |
| Ex. 2 | " | 4.0 | 42 | 300 | 0.35 | 17.1 | −7.4 | 1.36 | 0.07 |
| Ex. 3 | " | 4.0 | 52 | 200 | 0.28 | 15.4 | −7.6 | 1.38 | 0.07 |
| Ex. 4 | " | 5.5 | 61 | 100 | 0.35 | 16.0 | −7.8 | 1.36 | 0.07 |
| Ex. 5 | " | 4.0 | 49 | 50 | 0.45 | 30.0 | −7.6 | 1.33 | 0.07 |
| Ex. 6 | " | 8.0 | 56 | 200 | 0.29 | 18.5 | −12.6 | 1.34 | 0.09 |
| Ex. 7 | " | 6.6 | 50 | 200 | 0.30 | 17.1 | −10.1 | 1.34 | 0.08 |
| Ex. 8 | " | 3.0 | 45 | 200 | 0.33 | 17.3 | −7.7 | 1.36 | 0.07 |
| Ex. 9 | " | 2.5 | 55 | 200 | 0.44 | 21.6 | −7.3 | 1.33 | 0.07 |
| Ex. 10 | " | 4.0 | 65 | 200 | 0.40 | 18.8 | −7.5 | 1.34 | 0.07 |
| Ex. 11 | " | 4.0 | 40 | 200 | 0.42 | 20.0 | −7.9 | 1.33 | 0.08 |
| Comp. Ex. 1 | SA | 2.0 | 88 | 240 | 0.63 | 43.6 | −16.0 | 1.20 | 0.13 |
| Comp. Ex. 2 | IA | 4.0 | 59 | 550 | 0.80 | 60.0 | −7.8 | 1.10 | 0.07 |
| Comp. Ex. 3 | " | 4.0 | 49 | 30 | 0.78 | 78.0 | −7.7 | 1.11 | 0.08 |
| Comp. Ex. 4 | " | 9.0 | 54 | 200 | 0.31 | 16.0 | −20.0 | 1.32 | 0.18 |
| Comp. Ex. 5 | " | 2.0 | 63 | 200 | 0.70 | 57.5 | −7.9 | 1.15 | 0.08 |
| Comp. Ex. 6 | " | 4.0 | 70 | 200 | 0.72 | 27.0 | −8.0 | 1.16 | 0.08 |
| Comp. Ex. 7 | " | 4.0 | 35 | 200 | Dispersion gelled. | | | — | — |
| Comp. Ex. 8 | — | 0 | 42 | 200 | Dispersion gelled. | | | — | — |

Notes
(*1) IA: itaconic acid, SA: sulfonic acid
(*2) D.M.: degree of modification
(*3) D.S.: degree of saponification
(*4) D.P.: degree of polymerization
(*5) Dia.: average diameter of particles

What is claimed is:

1. A heat-sensitive recording material having a substrate and a heat-sensitive recording layer, comprising a heat-sensitive dye or color-developing agent or both and a modified polyvinyl alcohol containing about 2.5 to 8 mol. % of carboxyl group-containing monomer units and having a degree of saponification of about 40 to 65 mol. % and a viscosity average degree of polymerization of about 50 to 500.

2. The heat-sensitive recording material of claim 1, wherein said modified polyvinyl alcohol has a degree of saponification of about 45 to 60 mol. %.

3. The heat-sensitive recording material of claim 2, wherein said modified polyvinyl alcohol has a degree of saponification of about 50 to 60 mol. %.

4. The heat-sensitive recording material of claim 1, wherein said modified polyvinyl alcohol has a viscosity average degree of polymerization of about 100 to 300.

5. The heat-sensitive recording material of claim 1, wherein said modified polyvinyl alcohol is contained in said heat-sensitive recording layer in an amount of about 3 to 30 parts by wt. based on 100 parts by wt. of the sum of the amounts of the heat-sensitive dye and the color developing agent.

6. The heat-sensitive recording material of claim 5, wherein said modified polyvinyl alcohol is contained in said heat-sensitive recording layer in an amount of about 5 to 20 parts by weight.

7. The heat-sensitive recording material of claim 6, wherein said modified polyvinyl alcohol is contained in said heat sensitive recording layer in an amount of about 7 to 16 parts by weight.

8. The heat-sensitive recording material of claim 1, wherein said heat-sensitive recording layer further comprises an aqueous-based binder.

9. The heat-sensitive recording material of claim 1, wherein said coarboxyl group-containing monomer units are anhydride, phthalic anhydride, trimellitic anhydride or itaconic anhydride.

* * * * *